US012031743B2

(12) United States Patent
Ishigami et al.

(10) Patent No.: US 12,031,743 B2
(45) Date of Patent: Jul. 9, 2024

(54) INDOOR UNIT OF AIR-CONDITIONING APPARATUS HAVING VANE SHAFT CONNECTION MECHANISM AND AIR-CONDITIONING APPARATUS HAVING VANE SHAFT CONNECTION MECHANISM

(71) Applicant: Mitsubishi Electric Corporation, Tokyo (JP)

(72) Inventors: Katsuya Ishigami, Tokyo (JP); Keisuke Tomomura, Tokyo (JP); Tatsuo Furuta, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 465 days.

(21) Appl. No.: 17/422,467

(22) PCT Filed: Mar. 14, 2019

(86) PCT No.: PCT/JP2019/010469

§ 371 (c)(1),
(2) Date: Jul. 13, 2021

(87) PCT Pub. No.: WO2020/183685

PCT Pub. Date: Sep. 17, 2020

(65) Prior Publication Data

US 2022/0090818 A1 Mar. 24, 2022

(51) Int. Cl.

| | |
|---|---|
| ***F24F 13/12*** | (2006.01) |
| ***F24F 13/14*** | (2006.01) |
| ***F24F 13/20*** | (2006.01) |

(52) U.S. Cl.

CPC ..... *F24F 13/12* (2013.01); *F24F 13/20* (2013.01); *F24F 2013/1433* (2013.01)

(58) Field of Classification Search

CPC .. F24F 13/12; F24F 13/20; F24F 13/14; F24F 13/1426; F24F 13/22; F24F 1/0014; F24F 1/0047; F24F 1/0011; F24F 2013/1433

See application file for complete search history.

(56) References Cited

U.S. PATENT DOCUMENTS 5,388,426 A 2/1995 Wada et al.

FOREIGN PATENT DOCUMENTS

CN 206347709 U 7/2017
CN 108895646 A 11/2018

(Continued)

OTHER PUBLICATIONS

User1628671, Use of metal casing in small DC motors, May 29, 2018, Electrical Engineering Stack Exchange https://electronics.stackexchange.com/questions/377082/use-of-metal-casing-in-small-dc-motors (Year: 2018).*

(Continued)

*Primary Examiner* — Edelmira Bosques
*Assistant Examiner* — Michael James Giordano
(74) *Attorney, Agent, or Firm* — Posz Law Group, PLC

(57) ABSTRACT

An indoor unit of an air-conditioning apparatus includes a wind direction vane, a vane motor, an air passage wall, and a shaft joint member. Between a vane shaft and the air passage wall, an annular gap is provided. The shaft joint member includes a flange portion between the air passage wall and the vane motor. The flange portion radially extends outward from a center, thereby causing air that flows toward the vane motor through the annular gap to be diffused outward relative to a direction toward the vane motor.

16 Claims, 8 Drawing Sheets

(56) References Cited

FOREIGN PATENT DOCUMENTS

| | | | | | |
|---|---|---|---|---|---|
| JP | H02-57855 | A | | 2/1990 | |
| JP | 2001-124402 | A | | 5/2001 | |
| JP | 2010078273 | A | * | 4/2010 | |
| JP | 2015-124951 | A | | 7/2015 | |
| JP | 2015124950 | A | * | 7/2015 | |
| JP | 2015124951 | A | * | 7/2015 | |
| WO | 2017/042913 | A1 | | 3/2017 | |
| WO | WO-2017042913 | A1 | * | 3/2017 | ..... F24F 13/14 |

OTHER PUBLICATIONS

Office Action dated Dec. 7, 2022 issued in corresponding DE Patent Application No. 112019007023.1 (and English translation).
International Search Report dated May 28, 2019, issued in corresponding International Application No. PCT/JP2019/010469.
Office Action dated May 20, 2022 issued in corresponding CN Patent Application No. 201980093782.9 (and English translation).

* cited by examiner

INDOOR UNIT OF AIR-CONDITIONING APPARATUS HAVING VANE SHAFT CONNECTION MECHANISM AND AIR-CONDITIONING APPARATUS HAVING VANE SHAFT CONNECTION MECHANISM

CROSS REFERENCE TO RELATED APPLICATION

This application is a U.S. National Stage Application of International Application No. PCT/JP2019/010469, filed on Mar. 14, 2019, the contents of which are incorporated herein by reference.

TECHNICAL FIELD

The present disclosure relates to an indoor unit that is included in an air-conditioning apparatus, and that includes a wind direction vane, a vane motor, an air passage wall, and a shaft joint member, and relates to the air-conditioning apparatus.

BACKGROUND ART

For example, in many indoor units of air-conditioning apparatuses, a wind direction vane that changes the direction of conditioned air blown out from an air outlet is provided at an air outlet for the conditioned air. The wind direction vane includes a blade-like plate portion that guides conditioned air blown out from the air outlet. Vane shafts are provided at both ends of the plate portion as the center of rotation.

A main body of the indoor unit is provided with an air passage wall that isolates an air passage for conditioned air in the body from the outside where no conditioned air flows. The air passage wall has through-hole portions that serve as bearing portions associated with the respective vane shafts.

A vane motor is provided at one end portion of the wind direction vane, and the vane motor drives the wind direction vane to rotate the wind direction vane. The vane shaft and a rotary shaft of the vane motor are connected to each other by a shaft joint member.

In such an indoor unit, cool air cooled by a heat exchanger flows toward the outside from a through-hole through which the vane shaft extends. Then, the cool air may reach the vane motor. In such a case, dew is formed on the vane motor. The dew formed on the vane motor may drop from the indoor unit.

In the past, as measures against the above dropping of dew, a flange portion has been provided at the shaft joint member to seal the gap between the shaft joint member and the air passage wall. In this case, the length of a gap between the flange portion and a protruding end portion of the air passage wall is set smaller than the length of an annular gap formed between the shaft and the bearing portion of the air passage wall. In an adopted method, the gap between the flange portion and the protruding end portion of the air passage wall is seated, thereby preventing cool air that flows between the shaft and the barding portion of the air passage wall from entering the gap between the flange portion and the protruding end portion of the air passage wall (see Patent Literature 1, for example).

CITATION LIST

Patent Literature

Patent Literature 1: Japanese Unexamined Patent Application Publication No. 2015-124951

SUMMARY OF INVENTION

Technical Problem

However, in the technique disclosed in the above Patent Literature 1, the length of the gap between the flange portion and the protruding end portion of the air passage wall is reduced to achieve a sealed state between the flange portion and the protruding end portion of the air passage wall. Therefore, during rotation of the wind direction vane, the flange portion and the protruding end portion may come into contact with each other, as a result of which a malfunction may occur in the wind direction vane.

The present disclosure is applied to solve the above problem, and relates to an indoor unit of an air-conditioning apparatus and an air-conditioning apparatus in which dew can be prevented from adhering to a vane motor without adversely affecting the action of the wind direction vane.

Solution to Problem

An indoor unit of an air-conditioning apparatus according to an embodiment of the present disclosure includes: a wind direction vane configured to rotate about a vane shaft to change a flow direction of conditioned air that is blown out from an air outlet provided at an air passage for the conditioned air that is provided in a housing; a vane motor including a rotary shaft, and configured to drive the wind direction vane to rotate the wind direction vane; an air passage wall that isolates the air passage from an outside where no conditioned air flows; and a shaft joint member configured to connect one end portion of the vane shaft and one end portion of the rotary shaft, the vane shaft extending outward from the air passage wall. Between the vane shaft and the air passage wall, an annular gap is provided. The shaft joint member includes a flange portion between the air passage wall and the vane motor, and the flange portion radially extends outward from a center, thereby causing air that flows toward the vane motor through the annular gap to be diffused outward relative to a direction toward the vane motor.

An air-conditioning apparatus according to another embodiment of the present disclosure includes the above indoor unit.

Advantageous Effects of Invention

In the indoor unit of the air-conditioning apparatus and the air-conditioning apparatus according to the embodiments of the present disclosure, the shaft joint member includes the flange portion between the air passage wall and the vane motor. The flange portion radially extends outward from the center, thereby causing air that flows toward the vane motor through the annular gap to be diffused outward relative to the direction toward the vane motor, Therefore, the air that flows toward the vane motor through the annular gap is caused to avoid the vane motor by the flange portion, and is diffused outward relative to the direction toward the vane motor.

Accordingly, it is possible to prevent dew from adhering to the vane motor without adversely affecting the action of the wind direction vane.

DESCRIPTION OF EMBODIMENTS

The embodiment of the present disclosure will be described with reference to the figures. In each of the figures, components that are the same as or equivalent to those in a previous figure or figures are denoted by the same reference signs. The same is true of the entire text of the specification. In sectional views, hatching is omitted as appropriate in view of visibility. Furthermore, configurations of the components described in the entire text of the specification are merely examples. That is, the actual configurations of the components not limited to the configurations of the components described in the entire text of the specification.

Embodiment 1

Configuration of Air-Conditioning Apparatus 100

Figure 1:
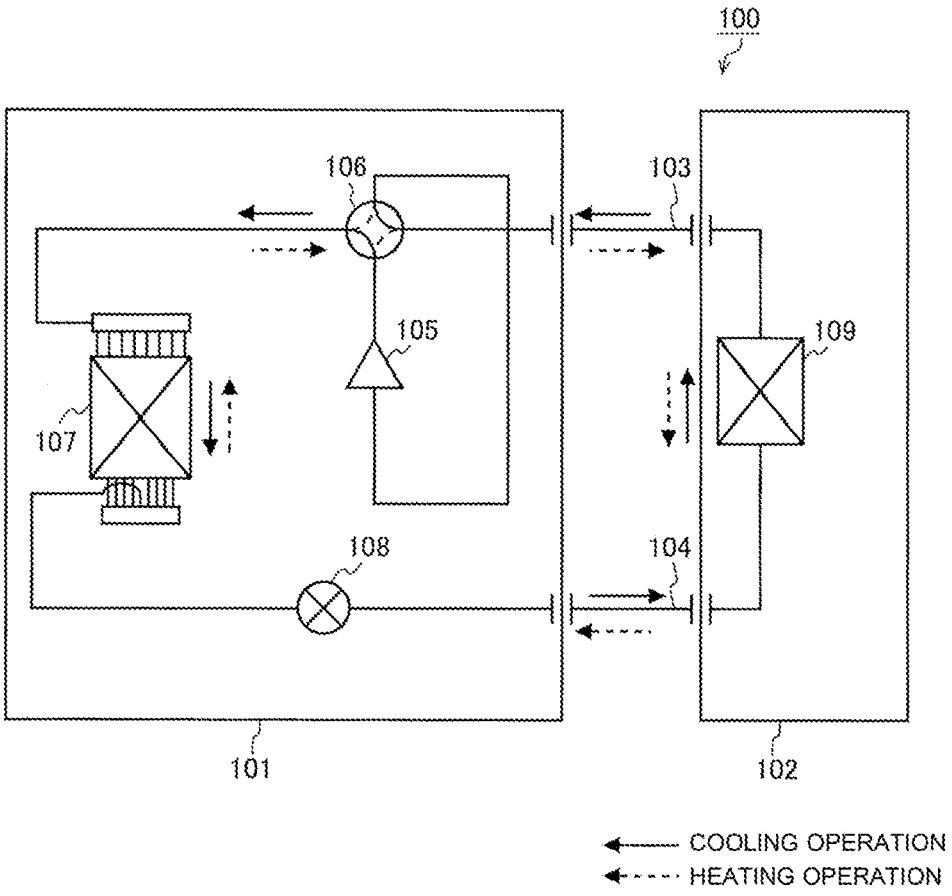
FIG. 1 is a refrigerant circuit diagram illustrating an air-conditioning apparatus according to Embodiment 1 of the present disclosure.

FIG. 1 is a refrigerant circuit diagram illustrating an air-conditioning apparatus 100 according to Embodiment 1 of the present disclosure. The air-conditioning apparatus 100 as illustrated in FIG. 1 includes an outdoor unit 101 and an indoor unit 102. The outdoor unit 101 and the indoor unit 102 are connected by a gas refrigerant pipe 103 and a liquid refrigerant pipe 104.

The outdoor unit 101 includes a compressor 105, a four-way valve 106, an outdoor heat exchanger 107, and an expansion valve 108.

The compressor 105 compresses sucked refrigerant, and discharges the compressed refrigerant. The compressor 105 may change the amount of refrigerant that is sent out from the compressor 105 per unit time, by arbitrarily changing the operating frequency with an inverter circuit, for example.

The four-way valve 106 is a valve that switches the flow direction of refrigerant between the flow direction of the refrigerant in a cooling operation and that in a heating operation, for example.

The outdoor heat exchanger 107 causes heat exchange to be performed between refrigerant and outdoor air. During the cooling operation, the outdoor heat exchanger 107 operates as a condenser to condense and liquefy the refrigerant. During the heating operation, the outdoor heat exchanger 107 operates as an evaporator to evaporate and vaporize the refrigerant.

The expansion valve 108 is a flow control valve, and reduces the pressure of refrigerant to expand the refrigerant. In the case where the expansion valve 108 is an electronic expansion valve, for example, the opening degree of the expansion valve 108 can be adjusted based on an instruction given by a controller (not illustrated) or other devices.

The indoor unit 102 includes an indoor heat exchanger 109. The indoor heat exchanger 109 causes heat exchange to be performed between air to be conditioned and refrigerant, for example. During the cooling operation, the indoor heat exchanger 109 operates as an evaporator to evaporates and vaporize the refrigerant. During the heating operation, the indoor heat exchanger 109 operates as a condenser to condense and liquefy the refrigerant.

Because of provision of the above configuration, the air-conditioning apparatus 100 can perform either the cooling operation or the heating operation by switching the flow direction of refrigerant using the four-way valve 106 of the outdoor unit 101.

Configuration of Indoor Unit 102

Figure 2:
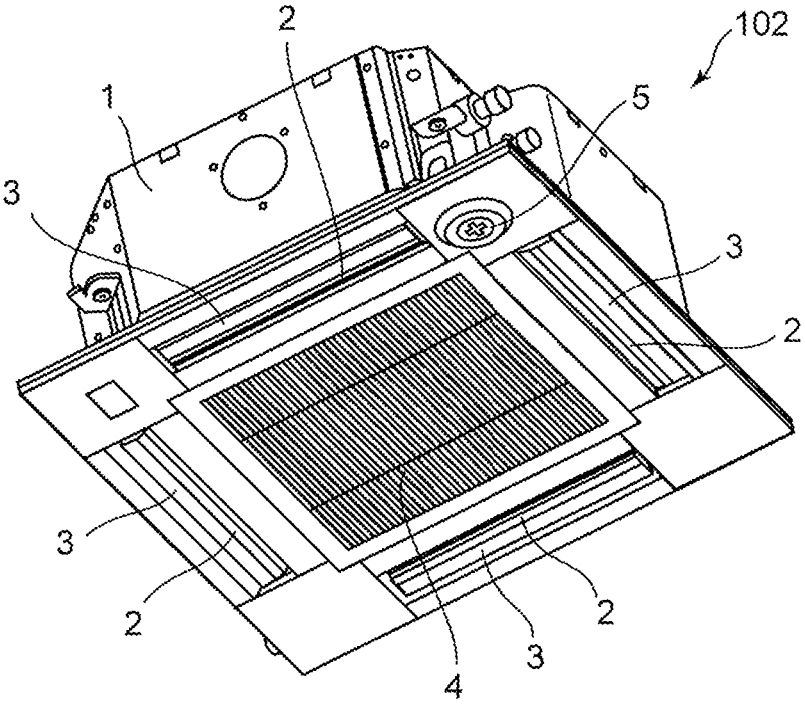
FIG. 2 is a perspective view illustrating an external appearance of an indoor unit of the air-conditioning apparatus according to Embodiment 1 of the present disclosure.
Figure 3:
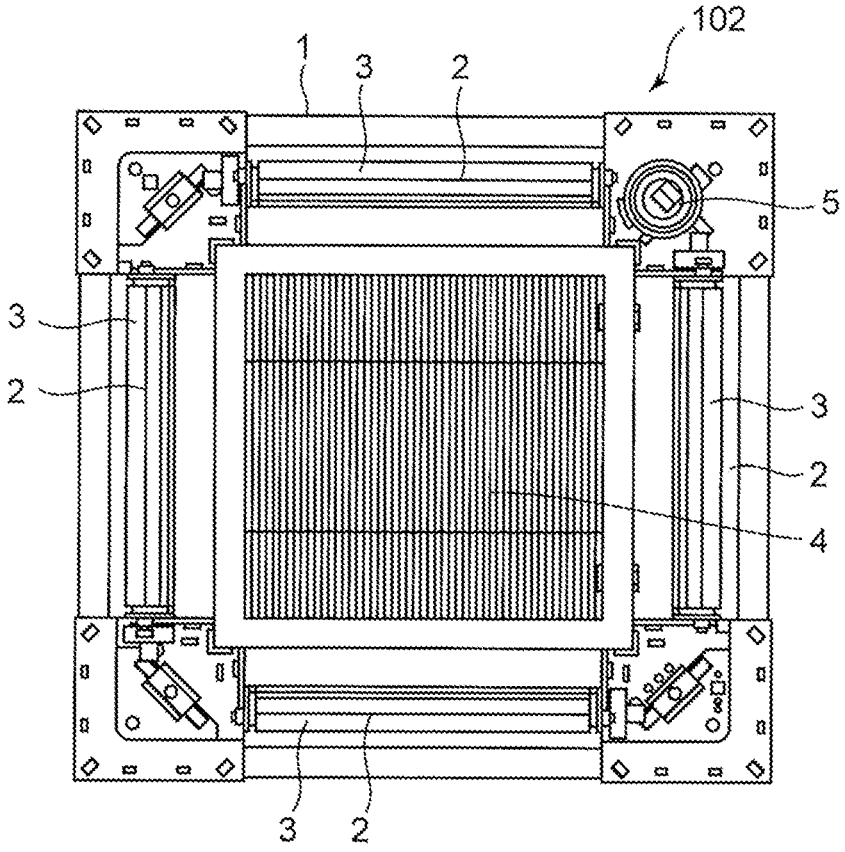
FIG. 3 is a bottom view of the indoor unit of the air-conditioning apparatus according to Embodiment 1 of the present disclosure.

FIG. 2 is a perspective view illustrating an external appearance of the indoor unit 102 of the air-conditioning apparatus 100 according to Embodiment 1 of the present disclosure. FIG. 3 is a bottom view of the indoor unit 102 of the air-conditioning apparatus 100 according to Embodiment 1 of the present disclosure. As illustrated in FIGS. 2 and 3, the indoor unit 102 is a ceiling embedded type indoor unit. The indoor unit 102 may also be any indoor unit, such as a wall mounted type indoor unit, a wall embedded type indoor unit, a ceiling suspended indoor unit, or a floor standing type indoor unit.

As illustrated in FIGS. 2 and 3, the indoor unit 102 includes a housing 1 having a lower surface having a square shape. Four air outlets 2 are provided in the lower surface of the housing 1 at positions close to respective side walls of the housing 1 such that each of the air outlets 102 is displaced from adjacent ones of the air outlets 102 by an angle of 90 degrees, and the four air outlets 2 allow conditioned air to be blown out. At the air outlets 2, respective wind direction vanes 3 are provided to change the blowing direction of conditioned air. Furthermore, an air inlet 4 is provided at a center area surrounded by the four air outlets 2, and allow indoor air to be sucked into the housing. At one of four corners of the lower surface of the housing 1, a sensor 5 is provided to detect a state of an indoor space.

Configuration of Wind Direction Vane 3

Figure 4:
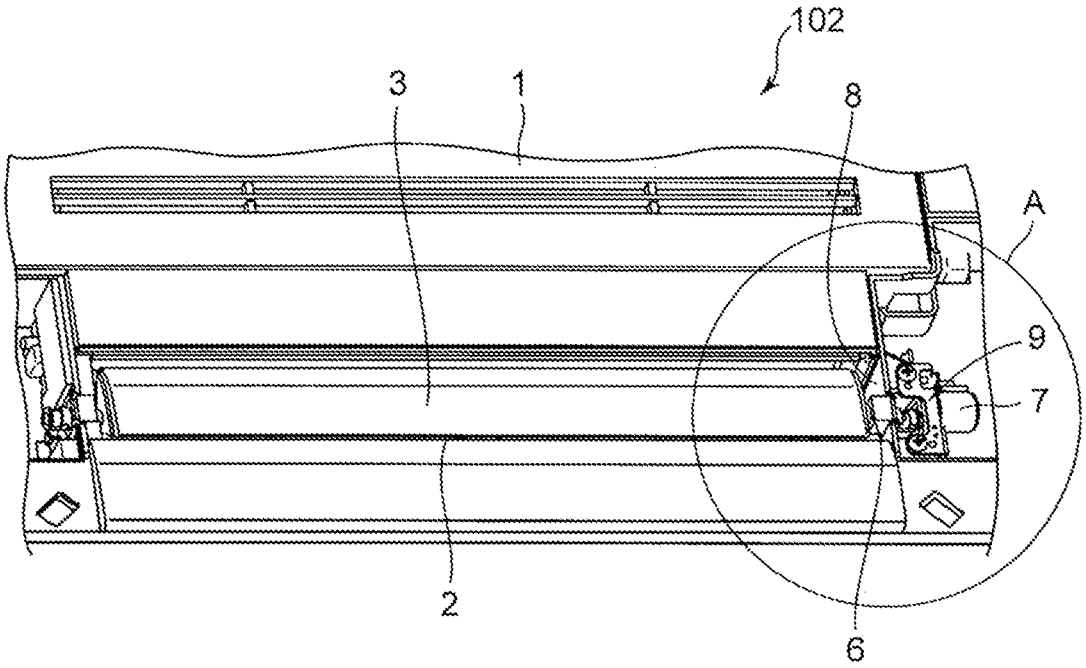
FIG. 4 is an overall view illustrating a wind direction vane according to Embodiment 1 of the present disclosure.

FIG. 4 is an overall view illustrating each of the wind direction vanes 3 according to Embodiment 1 of the present disclosure. As illustrated in FIG. 4, the wind direction vane 3 is rotated about a vane shaft 6 to change the flow direction of conditioned air that is blown out from the air outlet 2 that communicates with an air passage in the housing 1.

Configuration of Drive Unit of Wind Direction Vane 3

Figure 5:
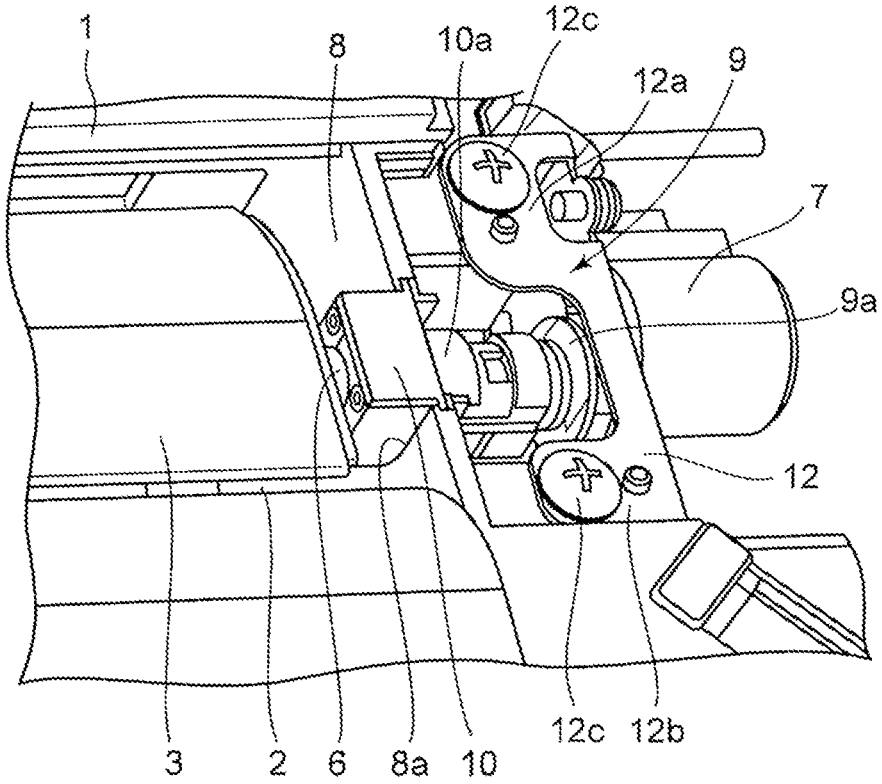
FIG. 5 is a partially enlarged view illustrating a drive unit of the wind direction vane according to Embodiment 1 of the present disclosure, which is indicated "A" in FIG. 4.
Figure 6:
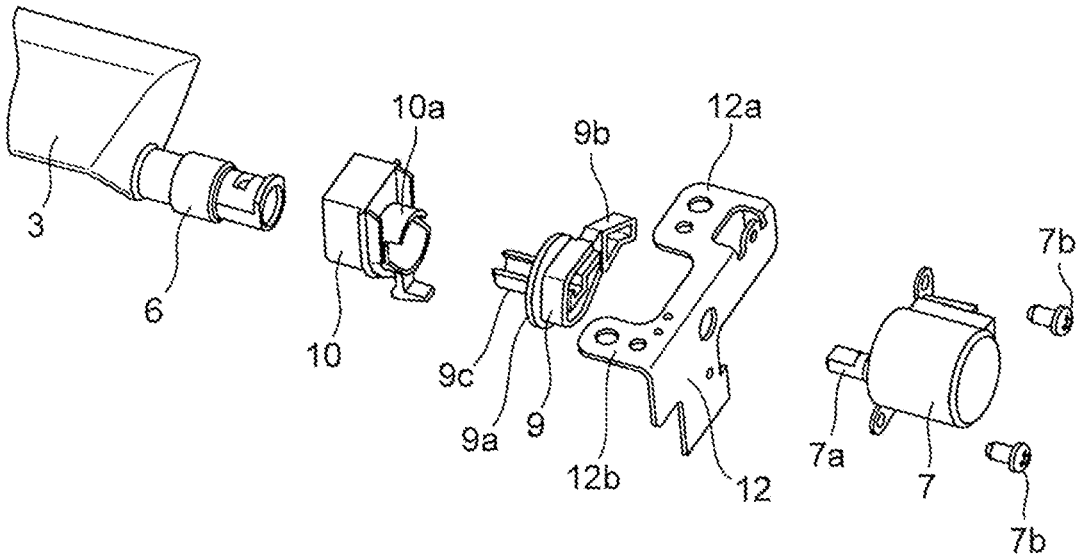
FIG. 6 is an exploded perspective view illustrating the drive unit of the wind direction vane according to Embodiment 1 of the present disclosure.
Figure 7:
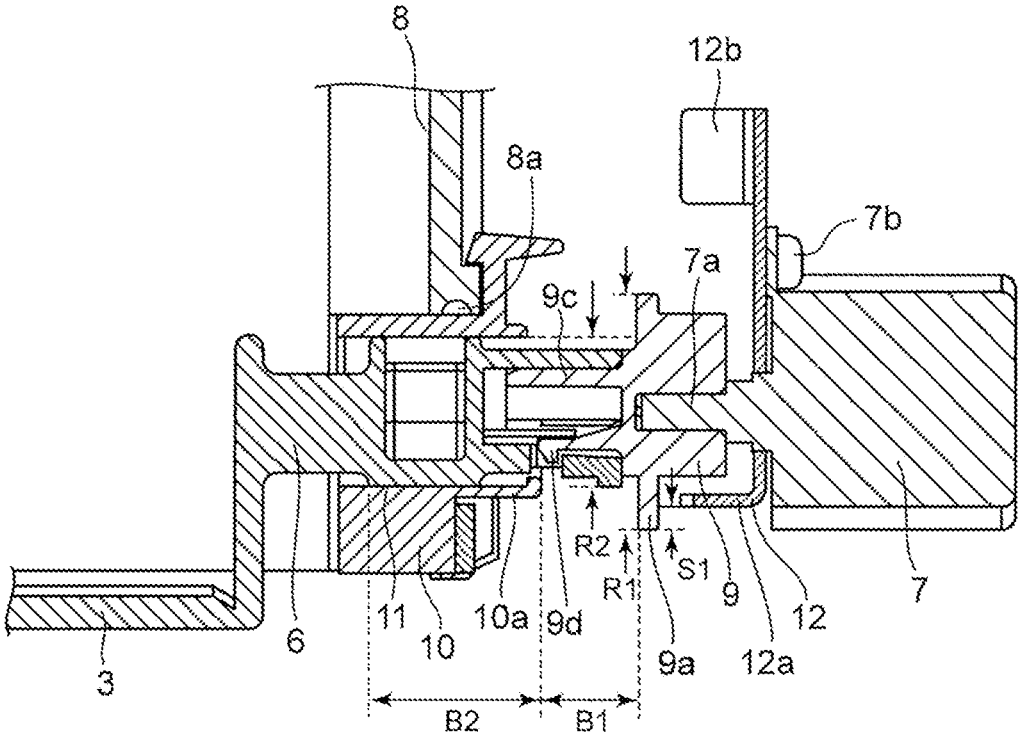
FIG. 7 is an explanatory view illustrating as a vertical sectional view the drive unit of the wind direction vane according to Embodiment 1 of the present disclosure in longitudinal cross section.

FIG. 5 is a partially enlarged view illustrating each of drive units of the wind direction vanes 3 according to Embodiment 1 of the present disclosure, which is indicate by "A" in FIG. 4. FIG. 6 is an exploded perspective view illustrating the drive unit of the wind direction vane 3 according to Embodiment 1 of the present disclosure. FIG. 7 is an explanatory view illustrating as a vertical sectional view the drive unit of the wind direction vane 3 according to Embodiment 1 of the present disclosure.

As illustrated in FIGS. 4, 5, and 7, each of the drive units of the four wind direction vane 3 includes a vane motor 7, an air passage wall 8, a shaft joint member 9, and a motor fixing plate 12. The drive units are provided at the four wind direction vanes 3, that is, respective wind direction vanes 3. The drive unit of each of the wind direction vanes 3 is provided on either the left side or the right side of the wind direction vane 3 as viewed from the lower surface of the housing 1.

The vane motor 7 includes a rotary shaft 7*a*, and drives the wind direction vane 3 to rotate the wind direction vane 3. The vane motor 7 may be a stepping motor, for example. An outer shell portion of the vane motor 7 is made of metal.

Figure 10:
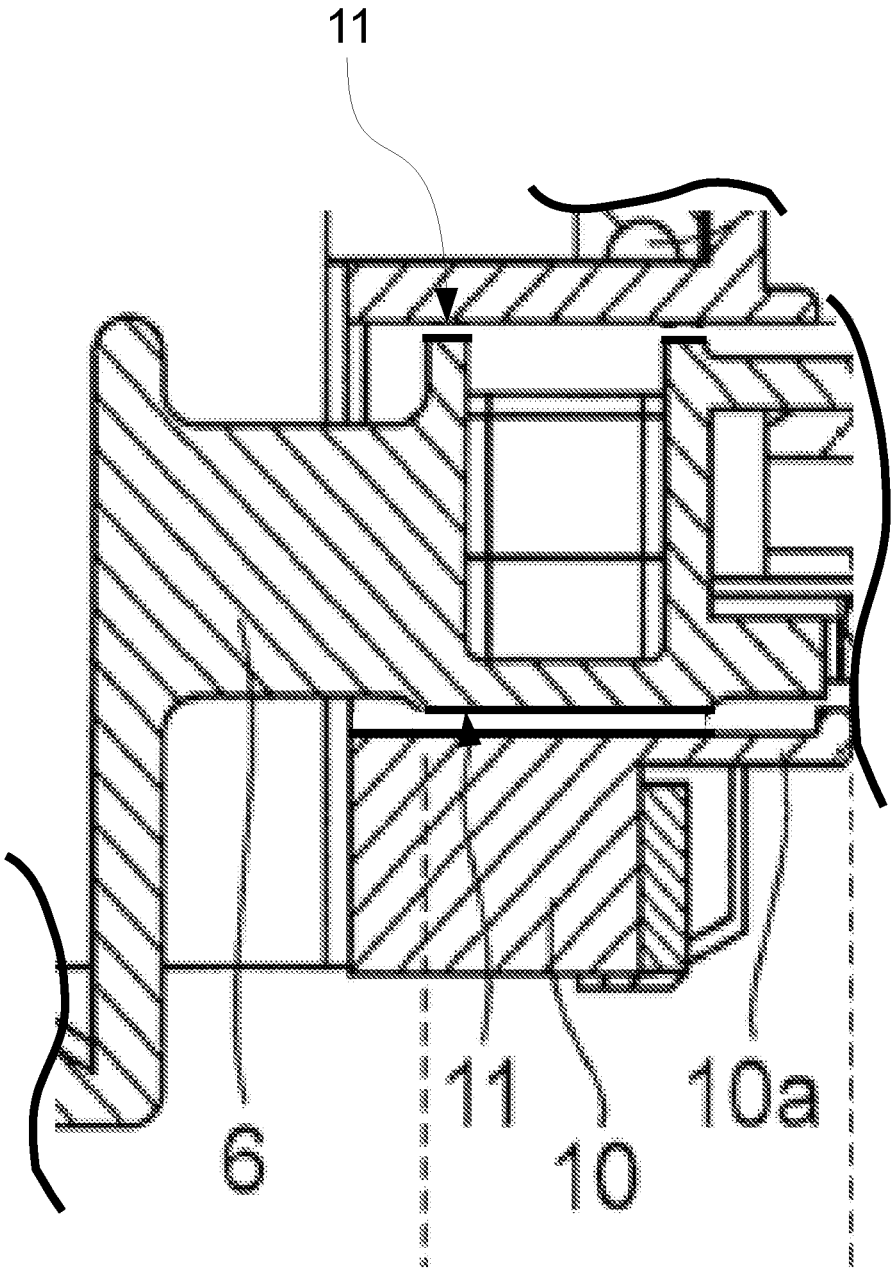
FIG. 10 illustrates a closeup view of FIG. 7.

The air passage wall 8 isolates the air passage in the housing 1 from the outside of the housing 1 where no conditioned air flows. Part of the air passage wall 8 includes a bush 10 that is attached to the air passage wall 8 itself as a bearing of the vane shaft 6. The bush 10 is fitted in an opening portion 8*a* formed in the air passage wall 8. The bush 10 of the air passage wall 8 includes a cylindrical portion 10*a* that extends outward from part of the air passage wall 8 by which the air passage in the housing 1 is isolated, and the cylindrical portion 10*a* covers the periphery of the vane shaft 6. Between the vane shaft 6 and the bush 10 fitted in the air passage wall 8, an annular gap 11 is provided, as illustrated in FIG. 10.

The motor fixing plate 12 is provided between the shaft joint member 9 and the vane motor 7. At the motor fixing plate 12, a first stopper 12*a* and a second stopper 12*b* are provided to restrict a rotation range of the wind direction vane 3. The first stopper 12*a* and the second stopper 12*b* protrude toward the air passage wall 8. The vane motor 7 is fixed to the motor fixing plate 12 by screws 7*b*. The motor fixing plate 12 is fixed to the housing 1 by screws 12*c*. The motor fixing plate 12 is made of metal.

Figure 8:
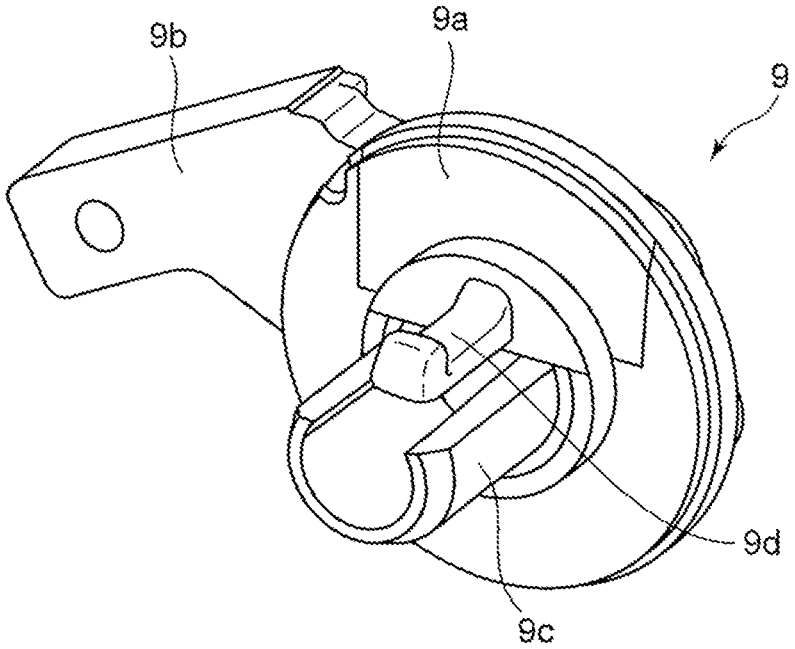
FIG. 8 FIG. 8 is a perspective view illustrating a shaft joint member according to Embodiment 1 of the present disclosure.

FIG. 8 is a perspective view illustrating the shaft joint member 9 according to Embodiment 1 of the present disclosure. As illustrated in FIGS. 5, 6, 7, and 8, the shaft joint member 9 connects one end portion of the vane shaft 6 and one end portion of the rotary shaft 7*a*. The vane shaft 6 extends outward from the bush 10, which is part of the air passage wall 8. The center axis of the vane shaft 6, the center axis of the rotary shaft 7*a*, and the center axis of the shaft joint member 9 are aligned with each other. The shaft joint member 9 includes a fitted shaft portion 9*c* that is fitted in the vane shaft 6. At the fitted shaft portion 9*c*, a hook 9*d* is provided. With the hook 9*d*, the vane shaft 6 and the shaft joint member 9 are engaged with each other. Also, with the hook 9*d*, the vane shaft 6 and the shaft joint member 9 are disengaged from each other. The shaft joint member 9 includes a flange portion 9*a* between the vane motor 7 and the bush 10, which forms part of the air passage wall 8. The flange portion 9*a* radially extends outward from the center axis so that air that flows toward the vane motor 7 through the annular gap 11 is radially diffused outward relative to the direction toward the vane motor 7. The flange portion 9*a* has a circular shape with respect to the center axis of the vane shaft 6 and the rotary shaft 7*a*. The flange portion 9*a* is located adjacent to part of the vane shaft 6 that is exposed from the bush 10, which forms part of the air passage wall 8. The shaft joint member 9 is made of a resin.

As illustrated in FIG. 7, an outside diameter R1 of the flange portion 9*a* is greater than an outside diameter R2 of the annular gap 11. The distance between the flange portion 9*a* and the outer end portion of the cylindrical portion 10*a* of the bush 10, which corresponds to an exposure length, is set to a space distance B1. The space distance B1 between the flange portion 9*a* and the outer end portion of the cylindrical portion 10*a* is greater than a gap width of the annular gap 11 in the radial direction.

Figure 11:
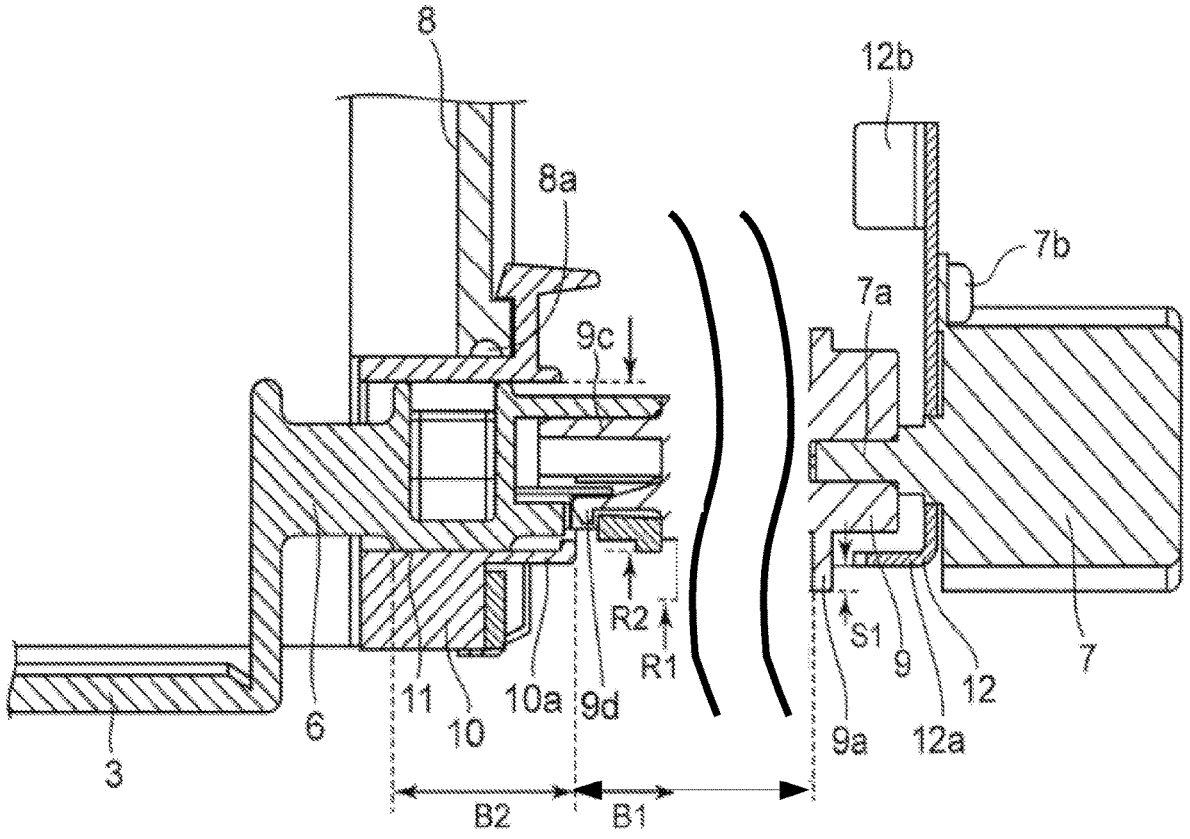
FIG. 11 is an explanatory view illustrating as a vertical sectional view the drive unit of the wind direction vane according to an alternative embodiment in longitudinal cross section.

The distance B1 between the flange portion 9*a* and the outer end portion of the cylindrical portion 10*a* is smaller than a sliding distance B2 by which the vane shaft 6 and the bush 10, which forms part of the air passage wall 8, are caused to slide over each other. However, the distance B1 is great to some extent. If the distance B1 is excessively small, the flange portion 9*a* is located closer to the air passage wall 8, and there is a possibility that the flange portion 9*a* will come into contact with the air passage wall 8. In this case, it is necessary to determine the dimension of the shaft joint member 9, including the flange portion 9*a*, in consideration of fixation of the vane motor 7 to the motor fixing plate 12 and also necessary to manage the dimensions of a plurality of components. In contrast, in Embodiment 1, in the case where the distance B1 is reliably ensured, there is little possibility that the flange portion 9*a* will come into contact with the air passage wall 8, and it therefore suffices to manage only the dimensions of the inside diameters of the vane shaft 6 and the bush 10. Thus, in Embodiment 1, the number of dimensions of components that need to be managed is small and a high productivity is achieved. Furthermore, the variance between the dimensions to be managed is also small, and it is therefore possible to reduce adhesion of dew to the vane motor 7 with a simple structure, and improve the reliability of the product. It is preferable that the space distance B1 between the flange portion 9*a* and the outer end portion of the cylindrical portion 10*a* be greater than the sliding distance B2 by which the vane shaft 6 and the air passage wall 8 are caused to slide over each other, as illustrated in FIG. 11.

As illustrated in FIGS. 6 and 8, at the shaft joint member 9, a restriction lever 9*b* is provided. A rotation range of the restriction lever 9*b* is restricted by the first stopper 12*a* or the second stopper 12*b*. The flange portion 9*a* is formed integral with the restriction lever 9*b*. The flange portion 9*a* is provided at a side of the restriction lever 9*b* that is closer to the air passage wall 8.

As illustrated in FIG. 7, the restriction lever 9*b* protrudes outward in the radial direction of the shaft joint member 9, and can be brought into contact with a protruding portion of the first stopper 12*a* or the second stopper 12*b*. The flange portion 9*a* is provided closer to the air passage wall 8 than the protruding portion of the first stopper 12*a*. The outside diameter R1 of the flange portion 9*a* is greater than a dimension of the protruding portion of the first stopper 12*a* in the radial direction by a distance S1.

Flow of Air in Drive Unit of Wind Direction Vane 3

Figure 9:
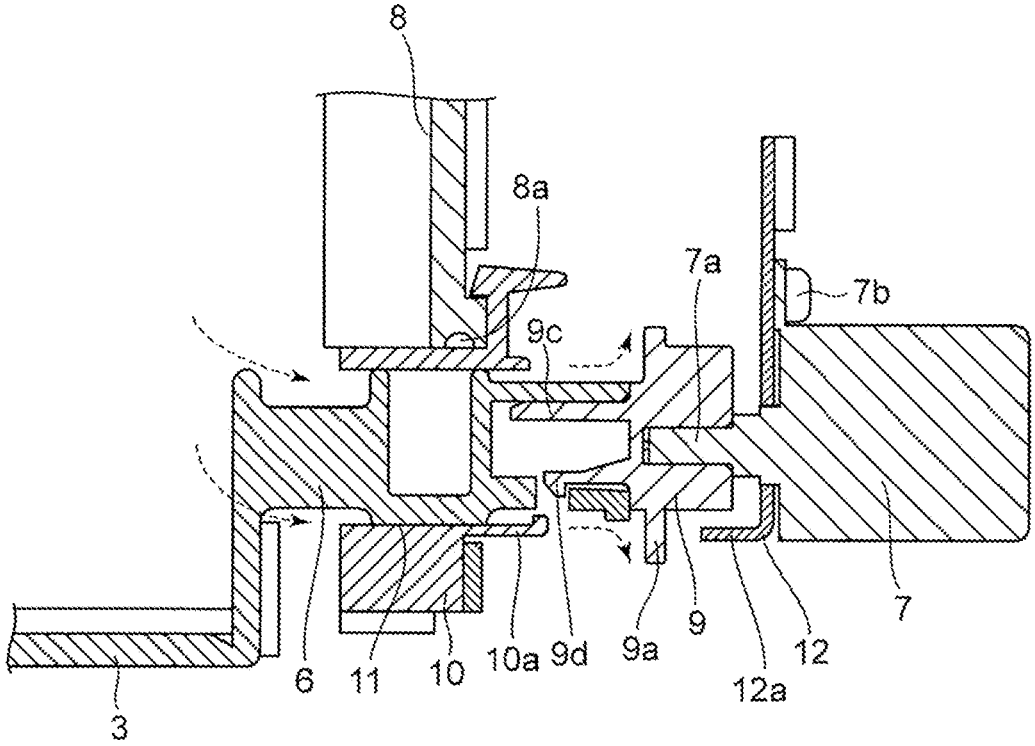
FIG. 9 is an explanatory view illustrating the flow of air in the drive unit of the wind direction vane according to Embodiment 1 of the present disclosure.

FIG. 9 is an explanatory view illustrating the flow of air in the drive unit of the wind direction vane 3 according to Embodiment 1 of the present disclosure. In FIG. 9, the flows of air are indicated by dashed arrows. Air in the air passage in the housing 1 enters the annular gap 11 provided between the vane shaft 6 and the bush 10, which forms part of the air passage wall 8. In a region between the vane shaft 6 and the cylindrical portion 10*a* extending from the bush 10, the flow of the air that has entered the annular gap 11 is adjusted such that air that flows toward the outside of the above region is straightened along the center axis of the vane shaft 6 and the rotary shaft 7*a*, which corresponds to the extending direction of the annular gap 11. After being straightened and blowing out to the outside, the air impinges against the flange portion 9*a*, which radially extends outward from the center axis of the vane shaft 6 and the rotary shaft 7*a*, and is thus radially and outwardly diffused.

Others

In the case where only the dimensions of the inner diameters of the vane shaft 6 and the bush 10 are managed, since the bush 10 is a component separate from the air passage wall 8, it is possible to improve the accuracy of molding of components. The bush 10 at the air passage wall 8 that slides over the vane shaft 6 is made of a material having a high sliding performance. Part of the vane shaft 6 that slides over the air passage wall 8 is made of a material having a high sliding performance.

Advantages of Embodiment 1

According to Embodiment 1, the indoor unit 102 of the air-conditioning apparatus 100 includes the wind direction vanes 3 each of which is rotated about the vane shaft 6 to change the flow direction of conditioned air that is blown out from an associated one of the air outlets 2 of the air passage in the housing 1, which allows the conditioned air to flow through the air passage. The indoor unit 102 of the air-conditioning apparatus 100 includes the vane motor 7 that includes the rotary shaft 7*a* to drive the wind direction vane 3 to rotate the wind direction vane 3. The indoor unit 102 of the air-conditioning apparatus 100 includes the air passage wall 8 that isolates the air passage from the outside where no conditioned air flows. The indoor unit 102 of the air-conditioning apparatus 100 includes the shaft joint member 9 that connects the one end portion of the vane shaft 6, which extends outward from the air passage wall 8, and the one end portion of the rotary shaft 7*a*. The annular gap 11 is provided between the vane shaft 6 and the bush 10, which forms part of the air passage wall 8. The shaft joint member 9 includes the flange portion 9*a* between the air passage wall 8 and the vane motor 7. The flange portion 9*a* radially extends outward from the center axis, and causes air that flows toward the vane motor 7 through the annular gap 11 to be outwardly diffused relative to the direction toward the vane motor 7.

In the above configuration, air that flows toward the vane motor 7 through the annular gap 11 is caused by the flange portion 9*a* to avoid the vane motor 7, and is radially diffused outward from the center axis. Accordingly, it is possible to prevent dew from adhering to the vane motor 7 without adversely affecting the action of the wind direction vane 3.

According to Embodiment 1, the outside diameter R1 of the flange portion 9*a* is greater than the outside diameter R2 of the annular gap 11.

With such a configuration, air that flows toward the vane motor 7 through the annular gap 11 is caused to avoid the vane motor 7 by the flange portion 9*a* that has a dimension greater than the outside diameter R2 of the annular gap 11, and is reliably radially diffused outward from the center axis.

According to Embodiment 1, the flange portion 9*a* is circular with respect to the center axis of the vane shaft 6 and the rotary shaft 7*a*.

In the above configuration, air that flows toward the vane motor 7 through the annular gap 11 is caused by the circular flange portion 9*a* to avoid the vane motor 7 such that the air uniformly flows around the vane shaft 6, and is radially diffused outward from the center axis.

According to Embodiment 1, the flange portion 9*a* is provided adjacent to part of the vane shaft 6 that is exposed from the air passage wall 8, and that has a length corresponding to the space distance B1, which is the exposure length measured as a finite distance.

In the above configuration, the flange portion 9*a* is separated from the air passage wall 8 by the space distance B1, which is the length of the exposed part of the vane shaft 6. It is therefore possible to prevent the flange portion 9*a* from coming into contact with the air passage wall 8, and the action of the wind direction vane 3 is not adversely affected.

According to Embodiment 1, the air passage wall 8 includes the cylindrical portion 10*a* of the bush 10. The cylindrical portion 10*a* extends outward from the part of the air passage wall 8 by which the air passage in the housing 1 is isolated, and the cylindrical portion 10*a* covers the periphery of the vane shaft 6.

In the above configuration, air in the air passage in the housing 1 enters the annular gap 11 provided between the vane shaft 6 and the cylindrical portion 10*a* extending from the bush 10, which forms part of the air passage wall 8. The air that passes through the annular gap 11 and flows out from the annular gap 11 to the outside is straightened along the center axis of the vane shaft 6 and the rotary shaft 7*a*, which corresponds to the extending direction of the annular gap 11. After being straightened and flowing out to the outside, the air impinges against the flange portion 9*a*, which radially extends outward from the center axis, and as a result is radially diffused outward from the center axis. Therefore, it is possible to prevent dew from adhering to the vane motor 7 without adversely affecting the action of the wind direction vane 3.

According to Embodiment 1, the space distance B1 between the flange portion 9*a* and the outer end portion of the cylindrical portion 10*a* is greater than the sliding distance B2 by which the vane shaft 6 and the air passage wall 8 are caused to slide over each other.

In the above configuration, the flange portion 9*a* is separated from the cylindrical portion 10*a* of the air passage wall 8 by the space distance B1 between the flange portion 9*a* and the outer end portion of the cylindrical portion 10*a*, the space distance B1 corresponding to the length of the exposed part of the vane shaft 6. Particularly, when the space distance B1 is greater than the sliding distance B2, the length of the exposed part of the vane shaft 6 can be reliably ensured. Therefore, the flange portion 9*a* is prevented from coming into contact with the air passage wall 8, and the action of the wind direction vane 3 is not adversely affected.

According to Embodiment 1, the space distance B1 between the flange portion 9*a* and the outer end portion of the cylindrical portion 10*a* is greater than the gap width of the annular gap 11.

In the above configuration, the flange portion 9*a* is separated from the cylindrical portion 10*a* of the air passage wall 8 by the space distance B1 between the flange portion 9*a* and the outer end portion of the cylindrical portion 10*a*, which corresponds to the length of the exposed part of the vane shaft 6. Particularly, when the space length B1, which corresponds to the length of the exposed part, is greater than the gap width of the annular gap 11, the length of the exposed part of the vane shaft 6 can be reliably ensured at the same time as the vane shaft 6 can be smoothly slid in the annular gap 11 such that the vane shaft 6 is rotatable. Accordingly, the flange portion 9*a* is prevented from coming into contact with the air passage wall 8, and the action of the wind direction vane 3 is not adversely affected.

According to Embodiment 1, the indoor unit 102 of the air-conditioning apparatus 100 includes the motor fixing plate 12 that fixes the vane motor 7 and that is located between the shaft joint member 9 and the vane motor 7. At the motor fixing plate 12, the first stopper 12*a* is provided to restrict the rotation range of the wind direction vane 3. At the shaft joint member 9, the restriction lever 9*b* is provided. The rotation range of the restriction lever 9*b* is restricted by the first stopper 12*a*. The flange portion 9*a* is integrally formed with the restriction lever 9*b*.

Because of provision of the above configuration, the shaft joint member 9 including the flange portion 9*a* can be easily manufactured.

According to Embodiment 1, the flange portion 9*a* is provided on a side of the restriction lever 9*b* that is closer to the air passage wall 8.

In the above configuration, the flange portion 9*a* integrally formed with the restriction lever 9*b* is located closer to the air passage wall 8 by the length of the exposed part of the vane shaft 6. Therefore, air that flows toward the vane motor 7 through the annular gap 11 is caused to avoid the vane motor 7 by the flange portion 9*a* that is closer to the air passage wall 8, and is precisely diffused outward relative to the direction toward the vane motor 7.

According to Embodiment 1, the first stopper 12*a* includes the protruding portion that protrudes toward the air passage wall 8. The restriction lever 9*b* protrudes in the radially outward direction from the center axis of the shaft joint member 9, and can be brought into contact with the protruding portion of the first stopper 12*a*. The flange portion 9*a* is provided closer to the air passage wall 8 than the protruding portion of the first stopper 12*a*.

In the above configuration, the flange portion 9*a* is prevented from interfering with the protruding portion of the first stopper 12*a*, and the action of the restriction lever 9*b* is not adversely affected.

According to Embodiment 1, the outside diameter R1 of the flange portion 9*a* is set such that in the radially outward direction from the center axis, an end portion of the flange portion 9*a* further extends by the distance S1 than the protruding portion of the first stopper 12*a*.

In the above configuration, the flange portion 9*a* is prevented from interfering with the protruding portion of the first stopper 12*a*, and the action of the restriction lever 9*b* is not adversely affected.

According to Embodiment 1, the outer shell portion of the vane motor 7 and the motor fixing plate 12 are made of metal. The shaft joint member 9 is made of a resin.

In the above configuration, since the outer shell portion of the vane motor 7 and the motor fixing plate 12 are made of metal, cooling air flows to the outer shell portion of the vane motor 7 and the motor fixing plate 12, and as a result dew adheres thereto. However, since the shaft joint member 9 is made of a resin, cool air that passed through the annular gap 11 is radially diffused outward from the center axis by the flange portion 9*a* of the shaft joint member 9, and dew that adheres to the flange portion 9*a* when cool air flows thereto does not cause a problem, such as corrosion.

According to Embodiment 1, the bush 10 of the air passage wall 8 that slides over the vane shaft 6 is made of a material having a high sliding performance.

In the above configuration, the vane shaft 6 and the bush 10, which is part of the air passage wall 8, more satisfactorily lubricate each other, and the bush can be rotated.

According to Embodiment 1, part of the vane shaft 6 that slides over the bush 10, which forms part of the air passage wall 8, is made of a material having a high sliding performance.

In the above configuration, the vane shaft 6 and the bush 10, which forms part of the air passage wall 8, more satisfactorily lubricate each other, and can be rotated.

According to Embodiment 1, the air-conditioning apparatus 100 includes the indoor unit 102 of the above air-conditioning apparatus 100.

In the above configuration, in the air-conditioning apparatus 100 including the indoor unit 102 of the air-conditioning apparatus 100, it is possible to prevent dew from adhering to the vane motor 7 without adversely affecting the action of the wind direction vane 3.

REFERENCE SIGNS LIST

1: housing, 2: air outlet, 3: wind direction vane, 4: air inlet, 5: sensor, 6: vane shaft, 7: vane motor, 7*a*: rotary shaft, 7*b*: screw, 8: air passage wall, 8*a*: opening portion, 9: shaft joint member, 9*a*: flange portion, 9*b*: restriction lever, 9*c*: fitted shaft portion, 9*d*: hook, 10: bush, 10*a*: cylindrical portion, 11: annular gap, 12: motor fixing plate, 12*a*: first stopper, 12*b*: second stopper, 12*c*: screw, 100: air-conditioning apparatus, 101: outdoor unit, 102: indoor unit, 103: gas refrigerant pipe, 104: liquid refrigerant pipe, 105: compressor, 106: four-way valve, 107: outdoor heat exchanger, 108: expansion valve, 109: indoor heat exchanger.

The invention claimed is:

1. An indoor unit of an air-conditioning apparatus, comprising:

a wind direction vane configured to rotate about a vane shaft to change a flow direction of conditioned air that is blown out from an air outlet provided at an air passage for the conditioned air that is provided in a housing;

a vane motor including a rotary shaft, and configured to drive the wind direction vane to rotate the wind direction vane;

an air passage wall that isolates the air passage from an outside where no conditioned air flows; and a shaft joint member configured to connect one end portion of the vane shaft and one end portion of the rotary shaft, the vane shaft extending outward from the air passage wall, wherein an annular gap is provided between the vane shaft and the air passage wall, and the shaft joint member includes a flange portion between the air passage wall and the vane motor, and the flange portion radially extends outward from a center, the shaft joint member includes a fitted shaft portion that extends axially with respect to a center axis of the rotary shaft and spaces the flange portion apart from the annular gap along a length of the fitted shaft portion, thereby causing air that flows toward the vane motor after exiting the annular gap to continue to flow axially along the vane shaft and then be diffused by the flange portion outward relative to a direction toward the vane motor, and the flange portion is circular with respect to the center axis of the vane shaft and the rotary shaft.

2. The indoor unit of the air-conditioning apparatus of claim 1, wherein an outside diameter of the flange portion is greater than an outside diameter of the annular gap.

3. The indoor unit of the air-conditioning apparatus of claim 1, wherein the flange portion is provided adjacent to part of the vane shaft that is exposed from the air passage wall and that has an exposure length.

4. The indoor unit of the air-conditioning apparatus of claim 1, wherein the air passage wall includes a cylindrical portion that extends outward from part of the air passage wall by which the air passage in the housing is isolated, the cylindrical portion covering a periphery of the vane shaft.

5. The indoor unit of the air-conditioning apparatus of claim 4, wherein a space distance between the flange portion and an outer end portion of the cylindrical portion is greater than a sliding distance by which the vane shaft and the air passage wall are caused to slide over each other.

6. The indoor unit of the air-conditioning apparatus of claim 4, wherein the space distance between the flange portion and the outer end portion of the cylindrical portion is greater than a gap width of the annular gap.

7. The indoor unit of the air-conditioning apparatus of claim 1, further comprising a motor fixing plate between the shaft joint member and the vane motor, the motor fixing plate being configured to fix the vane motor, wherein at the motor fixing plate, a stopper is provided to restrict a rotation range of the wind direction vane, at the shaft joint member, a restriction lever is provided, and a rotation range of the restriction lever is restricted by the stopper, and the flange portion is formed integral with the restriction lever.

8. The indoor unit of the air-conditioning apparatus of claim 7, wherein the flange portion is provided at part of the restriction lever that is closer to the air passage wall.

9. The indoor unit of the air-conditioning apparatus of claim 7, wherein the stopper protrudes toward the air passage wall, the restriction lever protrudes outward in a radial direction of the shaft joint member from a center of the shaft joint member, and is allowed to be brought into contact with the stopper, and the flange portion is provided closer to the air passage wall than the stopper.

10. The indoor unit of the air-conditioning apparatus of claim 7, wherein an outside diameter of the flange portion is greater than a dimension of the stopper in the radial direction from the center.

11. The indoor unit of the air-conditioning apparatus of claim 7, wherein an outer shell portion of the vane motor and the motor fixing plate are made of metal, and the shaft joint member is made of a resin.

12. The indoor unit of the air-conditioning apparatus of claim 1, wherein part of the air passage wall is configured to slide over the vane shaft.

13. The indoor unit of the air-conditioning apparatus of claim 1, wherein part of the vane shaft is configured to slide over the air passage wall.

14. An air-conditioning apparatus comprising the indoor unit of claim 1.

15. An indoor unit of an air-conditioning apparatus, comprising:

a wind direction vane configured to rotate about a vane shaft to change a flow direction of conditioned air that is blown out from an air outlet provided at an air passage for the conditioned air that is provided in a housing;

a vane motor including a rotary shaft, and configured to drive the wind direction vane to rotate the wind direction vane;

an air passage wall that isolates the air passage from an outside where no conditioned air flows; and a shaft joint member configured to connect one end portion of the vane shaft and one end portion of the rotary shaft, the vane shaft extending outward from the air passage wall, wherein an annular gap is provided between the vane shaft and the air passage wall, and the shaft joint member includes a flange portion between the air passage wall and the vane motor, and the flange portion radially extends outward from a center, thereby causing air that flows toward the vane motor through the annular gap to be diffused outward relative to a direction toward the vane motor, and the flange portion is circular with respect to a center axis of the vane shaft and the rotary shaft, wherein the air passage wall includes a cylindrical portion that extends outward from part of the air passage wall by which the air passage in the housing is isolated, the cylindrical portion covering a periphery of the vane shaft, wherein a space distance between the flange portion and an outer end portion of the cylindrical portion is greater than a sliding distance by which the vane shaft and the air passage wall are caused to slide over each other.

16. An indoor unit of an air-conditioning apparatus, comprising:

a wind direction vane configured to rotate about a vane shaft to change a flow direction of conditioned air that is blown out from an air outlet provided at an air passage for the conditioned air that is provided in a housing;

a vane motor including a rotary shaft, and configured to drive the wind direction vane to rotate the wind direction vane;

an air passage wall that isolates the air passage from an outside where no conditioned air flows; and a shaft joint member configured to connect one end portion of the vane shaft and one end portion of the rotary shaft, the vane shaft extending outward from the air passage wall, wherein an annular gap is provided between the vane shaft and the air passage wall, and the shaft joint member includes a flange portion between the air passage wall and the vane motor, and the flange portion radially extends outward from a center, thereby causing air that flows toward the vane motor through the annular gap to be diffused outward relative to a direction toward the vane motor, and the flange portion is circular with respect to a center axis of the vane shaft and the rotary shaft, further comprising a motor fixing plate between the shaft joint member and the vane motor, the motor fixing plate being configured to fix the vane motor, wherein at the motor fixing plate, a stopper is provided to restrict a rotation range of the wind direction vane, at the shaft joint member, a restriction lever is provided, and a rotation range of the restriction lever is restricted by the stopper, and the flange portion is formed integral with the restriction lever, wherein an outside diameter of the flange portion is greater than a dimension of the stopper in the radial direction from the center.

* * * * *